US006352101B1

(12) United States Patent
Ghosh et al.

(10) Patent No.: US 6,352,101 B1
(45) Date of Patent: Mar. 5, 2002

(54) REINFORCED CERAMIC SHELL MOLD AND RELATED PROCESSES

(75) Inventors: Asish Ghosh, Slingerlands; Frederic Joseph Klug, Schenectady, both of NY (US); Philip Harold Monaghan, Hampton, VA (US); Paul Steven Svec, Scotia; Robert Arthur Giddings, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/352,111

(22) Filed: Jul. 14, 1999

Related U.S. Application Data

(60) Provisional application No. 60/093,647, filed on Jul. 21, 1998.

(51) Int. Cl.[7] ..... B22C 9/00; B22C 1/02

(52) U.S. Cl. ..... 164/516; 164/519

(58) Field of Search ..... 164/361, 519, 164/516, 122.1, 122.2

(56) References Cited

U.S. PATENT DOCUMENTS

| | | | | | |
|---|---|---|---|---|---|
| 3,077,648 | A | * | 2/1963 | Sutherland | 164/22 |
| 3,654,984 | A | * | 4/1972 | Mellen, Jr. et al. | 164/26 |
| 1,410,634 | A | | 10/1975 | GBX | |
| 3,955,616 | A | | 5/1976 | Gigliotti, Jr. et al. | |
| 3,972,367 | A | | 8/1976 | Gigliotti, Jr. et al. | |
| 4,026,344 | A | | 5/1977 | Greskovich | |
| 4,031,945 | A | | 6/1977 | Gigliotti, Jr. et al. | |
| 4,086,311 | A | | 4/1978 | Huseby et al. | |
| 4,097,292 | A | | 6/1978 | Huseby et al. | |
| 4,966,225 | A | * | 10/1990 | Johnson et al. | 164/519 |
| 4,998,581 | A | | 3/1991 | Lane et al. | |
| 5,617,912 | A | * | 4/1997 | Ballewskie et al. | 164/517 |
| 5,778,960 | A | * | 7/1998 | Jackson et al. | 164/98 |
| 6,050,325 | A | * | 4/2000 | Wheaton | 164/516 |

OTHER PUBLICATIONS

Patent Abstract Japan—JP11156482—Hitachi Metals Precision Ltd.

Patent Abstract Japan—JP52095533—(Kuro–N) Kurotani Bijutsu KK.

Patent Abstracts of Japan—06277795–Daido Steel Co. Ltd.

Patent Abstracts of Japan—5601717–Kubota Ltd.

Patent Abstracts of Japan—55064945—Toshiba Corp.

* cited by examiner

*Primary Examiner*—M. Alexandra Elve
*Assistant Examiner*—Len Tran
(74) *Attorney, Agent, or Firm*—Robert P. Santandrea; Noreen C. Johnson

(57) ABSTRACT

A ceramic casting shell mold having a pre-selected shape is described. The shell mold comprises repeating layers of a ceramic material which define its wall thickness and shape. At least one of the layers of ceramic material contains refractory whiskers which provide structural reinforcement to the shell mold. The whiskers are usually incorporated into a layer of the ceramic material which is disposed at a position off-center of the wall-thickness of the mold. A method for making a ceramic casting shell mold is also described, as are metal- or metal alloy components cast in these shell molds.

15 Claims, No Drawings

REINFORCED CERAMIC SHELL MOLD AND RELATED PROCESSES

CROSS-REFERENCE TO RELATED APPLICATIONS

This application is related to Provisional Application 60/093,647. Filed on Jul. 21, 1998.

BACKGROUND OF THE INVENTION

This invention relates generally to the casting of metals. More specifically, it relates to shell molds used in the casting of metal components, e.g., components made from superalloys.

The casting of metals is carried out by various techniques, such as investment casting. Ceramic shell molds are used during investment-casting, to contain and shape the metal in its molten state. The strength and integrity of the mold are very important factors in ensuring that the metal part has the proper dimensions. These shell mold characteristics are especially critical for manufacturing high performance components, such as superalloy parts used in the aerospace industry.

Investment casting techniques often require very high temperatures, e.g., in the range of about 1450° C. to 1750° C. Many conventional shell molds do not exhibit sufficient strength at those temperatures. The molds become susceptible to bulging and cracking when they are filled with the molten metal. (Bulging can also occur when very large parts are being cast—even at lower temperatures). Bulging can alter the dimensions of the mold, thereby causing undesirable variation in the component being cast. Cracking could result in failure of the mold as the molten material runs out of it.

Clearly, greater strength and dimensional stability are required for shell molds used at very high casting temperatures, or for those used to cast very large parts. The problem is addressed by J. Lane et al in U.S. Pat. No. 4,998,581. In that disclosure, shell molds are strengthened by wrapping a fibrous reinforcing material around the shell mold as it is being made. In preferred embodiments, the reinforcing material is said to be an alumina-based or mullite-based ceramic composition having a specific, minimum tensile strength. The reinforcing material is apparently wrapped in spiral fashion around the shell mold with a tension sufficient to keep it in place as ceramic layers are applied to the mold to build it up to its desired thickness.

The Lane patent appears to provide answers to some of the problems described above. However, there appear to be some considerable disadvantages in practicing some embodiments of the invention disclosed in that patent. For example, mullite-based materials are difficult to produce without second phase inclusions of either silica- or alumina-containing compounds. These inclusions can degrade the physical properties of the mold. In addition, many of the reinforcing materials employed in U.S. Pat. No. 4,998,581 have thermal expansions much less than the thermal expansion of the mold. These large thermal expansion differences will make fabrication of a crack-free mold more difficult.

It should thus be apparent that further improvements in the properties of shell molds used under the conditions described above would be welcome in the art. The shell molds should have the strength to withstand high metal-casting temperatures, and should be suitable for casting large parts. The molds should also be dimensionally stable at elevated temperatures, and throughout various heating/cooling cycles. Moreover, if the molds are to be improved by the use of reinforcing materials, such materials should be flexible enough, before being fired, to satisfy the shape requirements for the mold, especially when intricate metal components are being cast. Finally, the preparation of improved shell molds should be economically feasible, e.g., not requiring the use of a significant amount of additional equipment. The use of the new molds should not result in undesirable increases in the cost for manufacturing metal parts in the investment casting process.

SUMMARY OF THE INVENTION

The present invention satisfies many of the needs described above. In one aspect, the invention embodies a ceramic casting shell mold which has a pre-selected shape. The shell mold comprises repeating layers of a ceramic material which define the wall thickness and shape of the mold. A key feature of this embodiment is that at least one of the layers of ceramic material contains whiskers which provide structural reinforcement to the shell mold. The whiskers are formed of a refractory material, such as an alumina-based material.

In preferred embodiments, the whiskers are incorporated into a layer of the ceramic material which is disposed at a position off-center of the wall-thickness of the mold, e.g., a slurry layer which is situated within about 10% to about 40% of the thickness from the inner wall of the mold. Frequently, at least two of the layers of ceramic material contain whiskers. In preferred embodiments, the whiskers in one of the adjacent layers are out of alignment with the whiskers in the other adjacent layer, e.g., are oriented at an angle of about 60 to about 90 degrees relative to the whiskers in the other adjacent layer.

Another embodiment of this invention is directed to a method for making a ceramic casting shell mold, comprising the steps of:

(I) applying a slurry which comprises ceramic-based whiskers to a ceramic layer-surface of a partial shell mold formed by applying successive ceramic layers over one another, forming a whisker-containing ceramic layer;

(II) completing the shell mold so that it has a desired wall-thickness, by applying additional ceramic layers over the whisker-containing ceramic layer; and then (III) firing the shell mold at an elevated temperature.

As described below, the whisker-containing ceramic layer is usually disposed at a position off-center of the wall-thickness of the mold. Moreover, more than one of the ceramic layers can contain whiskers. When whiskers are in multiple ceramic layers which are adjacent to one another, or relatively close to one another, the whiskers are preferably oriented so that they are out of alignment with the whiskers in adjacent or nearby layers.

Shell molds prepared by the method of the present invention also constitute part of the present invention, as do metal- and metal alloy components cast in these shell molds. Examples of such components are turbine engine parts.

Further details regarding the features of this invention are found in the remainder of the specification.

DETAILED DESCRIPTION OF THE INVENTION

Shell molds are usually composed of refractory particles (e.g., refractory oxide particles) bonded together by a silica or phosphate gel. Examples of the typical refractory particles are alumina-based materials, aluminate-based materials (such as yttrium aluminate), or mixtures of these materials. Various patents describe many aspects of conventional shell-molding processes. The following are exemplary, and are all incorporated herein by reference: U.S. Pat. Nos. 4,998,581 (Lane et al); 4,097,292 (Huseby et al); 4,086,311 (Huseby et al); 4,031,945 (Gigliotti, Jr. et al); 4,026,344 (Greskovich); 3,972,367 (Gigliotti, Jr. et al); and 3,955,616 (Gigliotti, Jr. et al).

One investment casting technique which is especially suitable for the present invention is the "lost wax" process. In one version of this technique, a wax pattern (i.e., a replica of the part being cast) is immersed repeatedly in a liquid slurry of refractory oxide (ceramic) particles in a silica- or phosphate-bearing binder. The particles typically have a spherical or tabular shape. Usually, the slurry is highly loaded with the ceramic solids, e.g., at least about 40 volume percent, with the remainder being deionized water, an organic solvent, or a mixture thereof. Sufficient time is provided between immersions to allow the slurry coat to partially or completely dry on the wax. After a sufficient thickness of ceramic has built up on the wax, the wax is removed by various techniques, as discussed below. The completed mold is then fired, providing it with enough strength to withstand the casting process.

Construction of the shell mold is usually carried out by applying a layer of the slurry to the wax pattern, followed by applying a layer of a stucco aggregate (e.g., made from commercially-available fused alumina) to the slurry layer, and then repeating the process a number of times. A typical chemical composition for a suitable slurry coat, after drying (and ignoring the stucco composition), includes about 80% to about 100% by weight of the alumina-based material, and about 20% to about 0% by weight of the binder material. Small amounts of other components are sometimes present, such as zircon.

The number of times the layer-sequence is repeated will of course depend on the desired thickness of the mold. Usually, about 4 to about 20 total ceramic slurry layer/stucco layer pairs are used for the shell mold. For some end uses, about 10 to about 18 layer pairs are applied. (It should be noted that the number of individual layers of ceramic coating and ceramic stucco does not always correspond to the center of the wall thickness of the mold. This is due in part to variation in the thickness of the individual layers, e.g., because of variations in ceramic particle size.)

In the present invention, at least one of the slurry layers comprises whiskers of refractory materials, e.g., refractory oxide materials. Examples of suitable refractory materials are those used in a typical shell mold slurry, and include alumina-based materials, aluminate-based materials (such as yttrium aluminate), silicon carbide-based materials, or any mixture of any of these materials. As used herein, the term "based" refers to the presence of the relevant material at a level of greater than about 50% by weight. Thus, these materials often contain other constituents as well, e.g., other ceramic oxides such as silicon dioxide, boron oxide, and the like. The use of whiskers is known in several arts, e.g., composite structures with plastics. Whiskers are technically referred to as "single axially-oriented crystal filaments", as described in *The Condensed Chemical Dictionary*, Tenth Edition, Van Nostrand Reinhold Company Inc., 1981, p. 1095, which is incorporated herein by reference.

However, the present invention contemplates a broader definition of "whiskers". The term can include any fiber of refractory material which has an average diameter of about 5 to about 200 microns, and an aspect ratio of about 5 to about 300. In preferred embodiments, the average diameter of the whiskers is in the range of about 8 to about 120 microns. A preferred aspect ratio is about 10 to about 200. The whiskers can be made by chopping strands of the appropriate ceramic material. They are also available commercially, e.g., from 3M Company. In preferred embodiments, the material from which the whiskers are made should exhibit a coefficient of thermal expansion (CTE) which is within about 50% of the CTE of the shell mold layers in which they will be incorporated. In especially preferred embodiments, the CTE of the whisker-material is within about 30% of the CTE of the shell mold layers.

The whiskers can fully replace the other ceramic particles in one or more slurry layers. Alternatively, the whiskers can replace a portion of the other ceramic particles. For example, a mixture of ceramic whiskers with the conventional ceramic ingredients, i.e., ceramic spheres and tabular ceramic particles, would be possible in many instances. The amount of whiskers employed will be determined by various factors, such as the composition of the whiskers; the shape and thickness of the mold; the required strength and dimensional stability of the mold; and the composition of the binder material and layer material in which the whiskers are being incorporated (as discussed below).

The whiskers are usually incorporated into at least one of the secondary slurry layers. As used herein, the "primary" layer or coat is defined as one of the first two layers of slurry applied, i.e., as part of the alternating set of slurry/aggregated coatings. The "secondary" layer or coat is defined as any layer applied after the primary layers have been applied. The whiskers are sometimes incorporated into two or three successive layers.

In some preferred embodiments, the whiskers are incorporated into one or more secondary slurry layers (sometimes adjacent to each other, i.e., successively-applied) of the partially-formed shell mold which are off-center of the wall-thickness of the mold. The present inventors have discovered that such a position appears to result in enhanced mold strength. In especially preferred embodiments, the whiskers are incorporated into one or more slurry layers at a wall thickness as close as possible to the inner wall of the mold, without adversely affecting the cavity surface (e.g., without causing surface roughness). For example, the whiskers can be incorporated into slurry layers which are situated within about 10% to about 40% of the thickness from the inner wall of the mold, and most preferably, within about 10% to about 25% of the thickness from the inner wall of the mold.

In other preferred embodiments, the whiskers are incorporated into one or more slurry layers (sometimes adjacent to each other) which are as close as possible to the outer wall of the mold, e.g., within about 10% to about 25% of the thickness from the outer wall. (Incorporation of the whiskers in a slurry layer which is too close to the outer wall may not provide the desired strength to the interior regions of the mold). In determining the most appropriate position for the whiskers, those skilled in the art can vary the position of the whiskers, and then evaluate the resulting physical properties of the mold, based on the teachings herein.

As mentioned above, the whiskers can be incorporated into more than one of the slurry layers. Moreover, they can be incorporated into more than one position within the thickness of the mold. As an example, whiskers can first be incorporated into one or more slurry layers which coincide with about 10% to about 40% of the thickness from the inner wall of the mold. Then, as the mold is built up, whiskers can also be incorporated into one or more slurry layers closer to the outer wall, e.g., layers which coincide with about 10% to about 25% of the thickness from the outer wall. Whiskers can be used in multiple positions in the shell mold in situations where a very high degree of mold strength is required. Those skilled in the art can determine the most appropriate arrangement of whiskers through experiment, by varying the number and position of the whisker-containing layers, and then evaluating the resulting physical properties of the shell mold.

When the whiskers are incorporated into a slurry layer of the mold, their presence may increase the viscosity of the slurry considerably. Thus, the amount of whiskers in the slurry should be high enough to provide the desired level of reinforcement, but low enough to maintain a "workable" viscosity for the shell mold building steps. In the case of alumina-based whiskers used with alumina-based ceramic shell materials, the amount of whiskers used for a given slurry layer will preferably be less than about 35% by volume, based on the total volume of the slurry material used to form the layer.

When the whiskers are incorporated into more than one of the shell mold layers, it is usually desirable to maintain the whiskers out of alignment from layer-to-layer. (As used herein, alignment refers to the alignment within the plane in which the whiskers are situated. The planes from layer to layer are substantially parallel to each other, since the layers are generally face-to-face.) This random alignment is especially desirable when whiskers are used in shell mold layers which are adjacent to each other. It is believed that if the whiskers are substantially aligned with those in adjacent layers (i.e., aligned along their longest axis), they may not provide the level of reinforcement desired for some embodiments of the present invention. As an example, the whiskers can have a cross-wise orientation to whiskers in an adjacent layer (even though the whiskers from layer to layer are not usually in physical contact). In some especially preferred embodiments, the whiskers are oriented at an angle of about 60 degrees to about 90 degrees relative to adjacent-layer whiskers, and most preferably, at about 90 degrees relative to adjacent-layer whiskers.

Various techniques can be practiced for maintaining the whiskers out of alignment from layer-to-layer. One illustration involves the lost wax process, which is further described herein. The wax pattern which is coated with the slurry of the ceramic coating material can be repositioned after each layer of whisker-containing slurry is applied. The repositioning is carried out relative to the direction of slurry-drainage. For example, if the pattern is rotated 90 degrees, the slurry material will drain in a direction 90 degrees from the slurry material of the preceding layer, and the whiskers will tend to align themselves with the new direction of drainage. The use of automated equipment during the drainage process simplifies the adjustments needed to achieve the desired alignment of whiskers.

The presence of the whiskers toughens the shell mold by providing a higher apparent elastic modulus. Moreover, the whiskers prevent substantial creep within the mold, which sometimes was a serious problem when the slurry layers contained only spherical or tabular ceramic particles. Dimensional stability of the mold—especially at high temperatures (e.g., casting temperatures of about 1450° C. to 1750° C.)—is a key attribute of the present invention. Furthermore, because of their shape and size, it is relatively easy to fully incorporate the whiskers into the selected layers of the mold. This feature is especially advantageous in those situations in which the mold may have a complicated shape, e.g., with corners, sharp angles, and/or changing angles. In some instances, whiskers can be incorporated into such a mold with greater ease and effectiveness compared to the incorporation of the spiral fiber described in the Lane patent.

The deposition of additional ceramic slurry/stucco aggregate layers is continued until the appropriate mold thickness is obtained. Usually, the mold, once fired, has a total wall thickness (i.e., from the inner wall to the outer wall) in the range of about 0.50 cm to about 2.50 cm, and preferably, about 0.50 cm to about 1.25 cm.

In some instances, cores are incorporated into shell molds being fabricated according to the present invention. The cores are often used to provide holes or cavities within the mold, and they may be formed by using inserts of vitreous silica, alumina, aluminates, or any combination of such materials, for example. The core material is removed from the final casting by conventional techniques. Many references describe the use of cores, e.g., *Modern Metalworking; Casting and Forming Processes in Manufacturing*; and U.S. Pat. Nos. 4,097,292, and 4,086,311, all mentioned above. The reinforcement-whiskers of this invention assist in maintaining the proper metal thickness around cores within the mold—especially when the mold would normally be susceptible to creep and distortion at high temperature. Precise control over the size of cavities within the mold is often critical when forming metal parts which have intricate shapes, and/or which have very rigorous dimensional requirements.

After the shell mold has been completed in the typical lost wax process, the wax is removed by any conventional technique. For example, flash-dewaxing can be carried out by plunging the mold into a steam autoclave, operating at a temperature of about 100° C.–200° C. under steam pressure (about 90–120 psi), for about 10–20 minutes. The mold is then usually pre-fired. A typical pre-firing procedure involves heating the mold at about 950° C. to about 1150° C., for about 60 minutes to about 120 minutes.

The shell mold can then be fired according to conventional techniques. The required regimen of temperature and time for the firing stage will of course depend on factors such as wall thickness, mold composition, and the like. Typically, firing is carried out at a temperature in the range of about 1350° C. to about 1750° C., for about 5 minutes to about 60 minutes. As the mold is fired, the whiskers react with the ceramic material in the shell mold. This reaction bonds the whiskers to the shell mold, providing greater strength and creep resistance to the mold.

Metal can immediately be poured into the mold at this time, to carry out a desired casting operation. Alternatively, the mold can be allowed to cool to room temperature. Further steps which are conventional to mold fabrication may also be undertaken. These steps are well-known in the field of shell molds. Examples include techniques for repairing and smoothing the surfaces of the mold.

Shell molds like those of the present invention are used for casting a wide variety of metals or metal alloys, such as titanium and nickel-based superalloys. Thus, components made from such materials with the reinforced shell mold are also within the scope of this invention.

A non-limiting, illustrative set of specific process steps for preparing shell molds according to this invention is as follows.

(1) A wax pattern is dipped into a slurry of −325 mesh tabular alumina and silica binder;

(2) The coated pattern is drained;

(3) The coated pattern is then placed in a rain machine with 80-grit fused alumina, for about 15–20 seconds;

(4) The pattern is air-dried;

(5) Steps 1–4 are repeated 2–8 times, using either the slurry used in step 1, or a whisker-containing slurry, as described below;

(6) The pattern is dipped in a suspension of −240 mesh and −325 mesh alumina, with a silica binder;

(7) The pattern is dipped in a fluidized bed of −54 mesh alumina;

(8) The pattern is then air-dried; and (9) Steps 6–8 are repeated about 8 times.

(Sometimes the first two layers applied in steps 1–4 are referred to as the "primary coat", while the layers applied in steps 6–9 are referred to as the "secondary coats").

As a non-limiting example, the whiskers can be incorporated into the third and forth slurry layers, or into the third, forth, and fifth slurry layers. Selection of the steps in which the whiskers are incorporated is based in part on the desired position for the whiskers, as described previously. Moreover, the wax pattern is preferably rotated at about 90 degrees between dips in the whisker-containing slurry, as described above. This rotation will ensure that the fired mold contains whiskers in one portion of the mold wall which are oriented at about 90 degrees relative to whiskers in another portion of the mold wall.

After preparation of the molds is complete, they are usually fired at 1000° C. in air, to develop additional handling strength. The molds can then be fired at about 1550° C.

While preferred embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present disclosure.

All of the patents, articles, and texts mentioned above are incorporated herein by reference.

What is claimed:

1. A ceramic casting shell mold having a pre-selected shape, comprising repeating layers of ceramic material which define a wall thickness and shape of the mold, wherein at least two adjacent layers of the ceramic material contain whiskers which provide structural reinforcement to the shell mold, wherein the whiskers in one of the adjacent layers are out of alignment with the whiskers in the other adjacent layer, wherein the whiskers in one of the adjacent layers are oriented at an angle of about 60 degrees to about 90 degrees relative to the whiskers in the other adjacent layer.

2. The shell mold of claim 1, wherein the whiskers are formed of a refractory material.

3. The shell mold of claim 2, wherein the whiskers are formed of a material selected from the group consisting of alumina-based materials, aluminate-based materials, silicon carbide-based materials, and mixtures of any of the foregoing materials.

4. The shell mold of claim 1, wherein the at least two adjacent layers of the ceramic material that contain whiskers are disposed at a position off-center of the wall-thickness of the mold.

5. The shell mold of claim 4, comprising an inner wall adjacent a mold cavity, and an outer wall opposite the inner wall, said walls being separated by the total thickness of the shell mold, wherein the at least two adjacent slurry layers which are situated within about 10% to about 40% of the thickness from the inner wall of the mold.

6. The shell mold of claim 4, comprising an inner wall adjacent a mold cavity, and an outer wall opposite the inner wall, said walls being separated by the total thickness of the shell mold, wherein the at least two adjacent slurry layers which are situated within about 10% to about 25% of the thickness from the outer wall.

7. The shell mold of claim 1, wherein the whiskers have an average diameter of about 5 microns to about 200 microns.

8. The shell mold of claim 1, wherein the whiskers have an aspect ratio in the range of about 10 to about 200.

9. A method for making a ceramic casting shell mold, comprising the steps of:

(I) applying a slurry which comprises ceramic-based whiskers to a ceramic layer-surface of a partial shell mold formed by applying successive ceramic layers over one another, forming at least two adjacent whisker-containing ceramic layers, wherein the whiskers in one of the adjacent layers are oriented so that they are out of alignment with the whiskers in the other adjacent layer, wherein the whiskers in one of the adjacent layers are oriented at an angle of about 60 degrees to about 90 degrees relative to the whiskers in the other adjacent layer;

(II) completing the shell mold so that it has a desired wall-thickness, by applying additional ceramic layers over the at least two adjacent whisker-containing ceramic layers; and then (III) firing the shell mold at an elevated temperature.

10. The method of claim 9, wherein the whiskers are formed of a material selected from the group consisting of alumina-based materials, aluminate-based materials, silicon carbide-based materials, and mixtures of any of the foregoing materials.

11. The method of claim 9, wherein the at least two adjacent whisker-containing ceramic layers are disposed at a position off-center of the wall-thickness of the mold.

12. The method of claim 11, wherein the ceramic casting shell mold comprises an inner wall adjacent a mold cavity, and an outer wall opposite the inner wall, said walls being separated by the total thickness of the shell mold, and wherein the at least two adjacent whisker-containing ceramic layers are disposed within about 10% to about 40% of the thickness from the inner wall of the shell mold.

13. A shell mold prepared by the method of claim 9.

14. A metal- or metal alloy component cast in the shell mold of claim 13.

15. A turbine engine component prepared from the metal- or metal alloy component of claim 14.

* * * * *